US008096031B2

(12) United States Patent
Decker et al.

(10) Patent No.: US 8,096,031 B2
(45) Date of Patent: Jan. 17, 2012

(54) HAND TOOL FOR ENGAGING A PUSH-LOCK FITTING

(75) Inventors: Randall H. Decker, Thompson's Station, TN (US); Martin J. Champ, Nashville, TN (US); Ronald Topinka, Franklin, TN (US)

(73) Assignee: GM Global Technology Operations LLC, Detroit, MI (US)

( * ) Notice: Subject to any disclaimer, the term of this patent is extended or adjusted under 35 U.S.C. 154(b) by 673 days.

(21) Appl. No.: 12/188,300

(22) Filed: Aug. 8, 2008

(65) Prior Publication Data

US 2010/0031485 A1 Feb. 11, 2010

(51) Int. Cl.
*B25B 27/02* (2006.01)

(52) U.S. Cl. ..... 29/237; 29/270; 29/278; 29/255; D8/28

(58) Field of Classification Search ..... 29/237, 29/238, 244, 255, 270, 278; 81/488, 119, 81/176.1, 176.2, 125.1, 124.4; D8/17.21, D8/27, 28

See application file for complete search history.

(56) References Cited

U.S. PATENT DOCUMENTS

| | | | | | |
|---|---|---|---|---|---|
| 5,303,619 | A * | 4/1994 | Cole, Sr. | ..... | 81/180.1 |
| 5,492,040 | A * | 2/1996 | Bellas | ..... | 81/125.1 |
| 5,537,727 | A * | 7/1996 | Mayer | ..... | 29/237 |
| 5,685,207 | A * | 11/1997 | Hubert | ..... | 81/177.5 |
| D410,178 | S * | 5/1999 | Clayson | ..... | D8/16 |
| D411,945 | S * | 7/1999 | Chen | ..... | D8/28 |
| D416,178 | S * | 11/1999 | Moore et al. | ..... | D8/16 |
| 6,012,211 | A * | 1/2000 | Ochoa et al. | ..... | 29/426.5 |
| D435,765 | S * | 1/2001 | Owens et al. | ..... | D8/28 |
| 2010/0031485 | A1 * | 2/2010 | Decker et al. | ..... | 29/237 |

* cited by examiner

*Primary Examiner* — Lee D Wilson
(74) *Attorney, Agent, or Firm* — Lionel D. Anderson; Reising Ethington P.C.

(57) ABSTRACT

A hand tool that can be used to physically engage a release feature on a push-lock fitting so that a tube, hose, or other conduit can be easily inserted into and/or removed from the fitting. This can be particularly useful with industrial machines that have a number of pneumatic fittings installed close together in a tight proximity. According to one embodiment, the hand tool includes an elongated body portion, engagement portions located at opposing ends of the body portion, and transition portions located therebetween. Each engagement portion includes an open pocket for fitting around the tube, and a contact surface for engaging the release feature.

18 Claims, 1 Drawing Sheet

HAND TOOL FOR ENGAGING A PUSH-LOCK FITTING

TECHNICAL FIELD

The present invention generally relates to hand tools commonly used with pneumatic or hydraulic machines and, more particularly, to hand tools for engaging push-lock fittings in order to facilitate the easy installation or removal of a tube, hose, or other conduit.

BACKGROUND

Industrial and manufacturing machines oftentimes include fittings for receiving tubes, hoses, and other components. For example, welding guns, load assist machines, and robotic equipment may include a number of fittings for connecting the apparatuses to a pneumatic or hydraulic source.

One type of fitting that is commonly used with pneumatic machines is a push-lock fitting; the term 'push-lock fitting' broadly includes any type of fitting, coupling, connection piece, etc. that includes a release feature which must be physically engaged by an operator in order to install and/or remove a tube, hose, or other conduit from the fitting. It should be appreciated that push-lock fittings can be used with a wide variety of machines, and are not limited to pneumatic machines or the specific examples provided above.

SUMMARY OF THE INVENTION

According to one embodiment, there is provided a hand tool for engaging a push-lock fitting having a release feature, the hand tool generally comprises a body portion and an engagement portion. The engagement portion includes a contact surface and an open pocket formed between first and second prongs, wherein the open pocket fits around an exterior surface of a tube so the contact surface can engage the release feature on the push-lock fitting.

According to another embodiment, there is provided a hand tool for engaging a push-lock fitting having a release feature, the hand tool generally comprises an elongated body portion, a first engagement portion, and a second engagement portion. The first engagement portion includes a first open pocket that is formed between a pair of prongs and fits around an exterior surface of a tube so that contact surfaces on a flat side of the hand tool can engage the release feature of the push-lock fitting. The second engagement portion includes a second open pocket that is formed between a pair of prongs and fits around an exterior surface of a tube so that contact surfaces on a flat side of the hand tool can engage the release feature of the push-lock fitting, wherein the first and second open pockets are different sizes.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
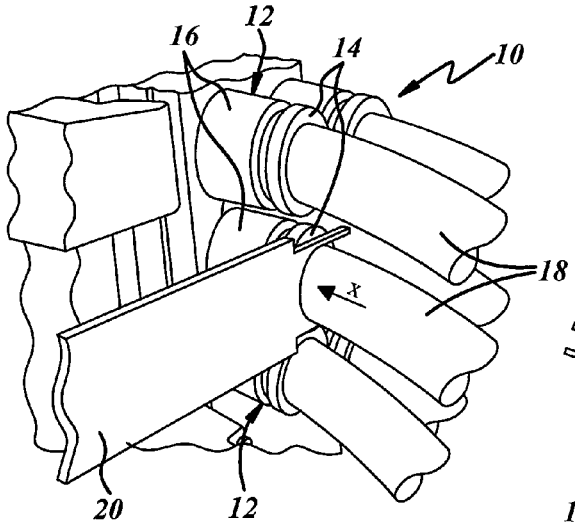
FIG. 1 is a perspective view of an exemplary embodiment of a hand tool being used to remove a tube from a push-lock fitting.

The hand tool described below can be used to physically engage a push-lock fitting so that a tube, hose, or other conduit can be easily inserted into and/or removed from the fitting. This can be particularly useful with industrial machines that have a number of pneumatic fittings installed close together in a tight proximity, such as the example shown in FIG. 1.

In that figure, a portion of an industrial machine is shown with a pneumatic fittings cluster 10 having multiple push-lock fittings 12. Each push-lock fitting 12 connects a separate tube 18 to the industrial machine, and includes a release feature 14 and a fitting housing 16. According to the exemplary embodiment shown here, release feature 14 is an annular ring that is generally concentric with fitting housing 16 and is biased axially outwardly away from the fitting. In order to remove tube 18 from push-lock fitting 12, release feature 14 must be depressed into fitting housing 16; i.e., in an inwardly axial direction x, against the outward bias of the release feature. Pressing release feature 14 into fitting housing 16 causes internal clamping features within push-lock fitting 12 to retract so that tube 18 is released and can thereafter be removed. A similar process of depressing release feature 14 can be used to insert tube 18 into push-lock fitting 12.

As is appreciated by skilled artisans, release feature 14 should be depressed in a generally even and uniform manner, so that the annular ring does not become misaligned with respect to fitting housing 16. If the annular ring is unevenly engaged, the internal clamping features mentioned above do not properly retract and the tube may not be released by the push-lock fitting. This can result in a scoring or tearing of the exterior sheathing of hose 18, which is usually made of a material like nylon or polypropylene. Furthermore, if the push-lock fittings are mounted in an area where there is little clearance, it can make it difficult for an operator to properly engage release feature 14, thus complicating and possibly frustrating the tasks of installing and/or removing tubes from the fittings.

Figure 2:
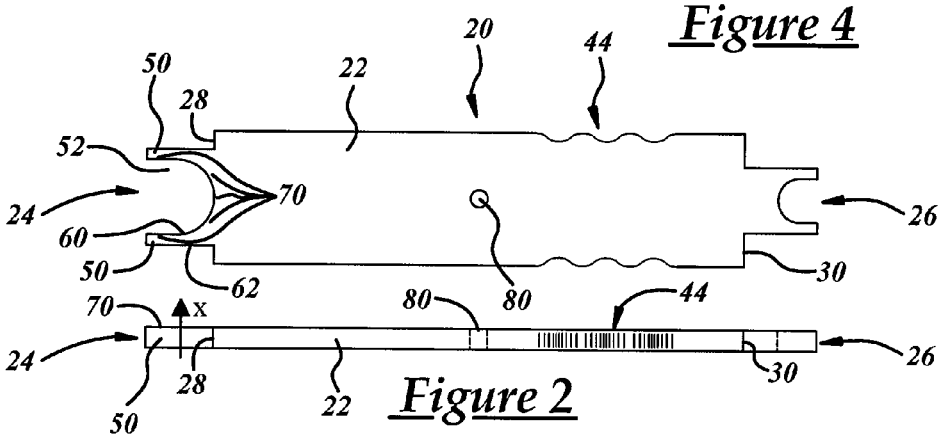
FIG. 2 includes a top and side view of the exemplary hand tool of FIG. 1.

Turning now to FIG. 2, there is shown an exemplary embodiment of a hand tool 20 that can be used to engage a push-lock fitting, such as those shown in FIG. 1, so that a tube, hose, or other item can be easily installed and/or removed from the fitting. In this particular embodiment hand tool 20 is made of a rigid and durable material, such as a suitable metal or plastic, and generally includes a body portion 22, first and second engagement portions 24, 26, and first and second transition portions 28, 30. It should be appreciated that the hand tool shown and described here is just an exemplary embodiment and that other embodiments, including ones not shown here, could be used instead.

Body portion 22 forms the majority of the tool and can provide an operator with means for gripping and manipulating the hand tool. In the embodiment shown here, body portion 22 is an elongated piece that extends between first and second engagement portions 24 and 26. Depending on the nature of its intended use, body portion 22 can be rectangular in shape (examples shown in FIGS. 2 and 3), it can have curved or angled sides (not shown), or it can have some other suitable configuration. It is also possible for body portion 22 to be equipped with one or more ergonomic gripping features 44 on an exterior surface of the body portion. These gripping features can promote or improve manual engagement by an operator and can come in a variety of forms. For example, gripping features 44 could include scalloped or contoured edges along the sides of body portion 22, as shown in FIG. 2, or they could include synthetic and/or natural materials, coatings, etc. applied to the body portion in order to act as a no-slip handle. These are, of course, only some of the possibilities for gripping features, as numerous others could be used as well.

First engagement portion 24 is located at a distal end of body portion 22 and, according to this particular embodiment, is integrally formed with the body portion and includes a pair of prongs 50 that form an open pocket 52. Prongs 50 can be finger-like projections that extend away from body portion 22 to form an open pocket 52 that is designed to fit around an exterior surface of a tube, hose, or other conduit (see FIG. 1, for example). Prongs 50 can have a number of different shapes, but the embodiment shown here includes prongs with a curved inner surface 60 that forms a semi-circular shape and a straight outer surface 62 that helps define the engagement portion. The semi-circular shape is preferably designed to be slightly larger in size than the exterior surface of the tube with which it engages (e.g., the open pocket can be several thousandths of an inch larger than the outer diameter of tube 18). This promotes easy insertion of open pocket 52 around tube 18, but does so in a way where the hand tool is firmly installed without too much excess tolerance. It is possible to add a protective coating to curved inner surfaces 60 to prevent damage to the exterior surface of tube 18. For instance, a protective plastic coating could be applied to curved inner surface 60 so that the inner surface did not scratch or score the outer sheathing of tube 18.

As mentioned earlier, it can sometimes be difficult for an operator to evenly or uniformly depress release feature 14 so that push-lock fitting 12 cleanly releases tube 18. One way to improve this is to provide an engagement portion that has a sufficiently sized contact surface 70, which is located on the flat side of hand tool 20 surrounding open pocket 52 and contacts the annular release feature 14. By using contact surface 70 to exert force on release feature 14 in a direction x (generally aligned with axis of push-lock fitting 12), the force is distributed across a large portion of the release feature so that it is depressed in a generally even and uniform manner. In one embodiment, contact surface 70 extends around open pocket 52 by a distance that is equal to or greater than approximately one third of the circumference of the tube with which it engages. If, for example, the contact surface only extended around the open pocket for a very short distance, then engagement of the release feature could cause the annular ring to be depressed in an angled or uneven way. As previously explained, this can prevent clamping features inside the fitting from fully retracting and releasing the tube.

Open pocket 52 is designed to easily slip over a tube, hose or other conduit, and can have one of a number of different configurations. In the example shown in FIG. 2, open pocket 52 has a semi-circular shape that is designed to engage a tube or hose having a circular cross-section. Other open pocket designs could be used instead, and those designs could include non-semi-circular shapes such as polygonal shapes, elliptical or oval shapes, hex shapes, and other designs known in the art, so long as the open pocket can be slipped over top of a hose. As previously mentioned, it is desirable for open pocket 52 to be slightly larger than the outer diameter of the hose that it is used with (e.g., the open pocket can be several thousandths of an inch larger). Some common hose sizes range from about ¼" to ¾" (about 6 mm-20 mm in metric tubing), however, other sizes could be used as well.

First transition portion 28 is located between body portion 22 and first engagement portion 24 and, according to this particular embodiment, is an abrupt neck-down between the wider body portion and the narrower engagement portion. Transition portion 28 results in an engagement portion that is smaller and, thus, sometimes more suitable for being used with applications having tight tolerances where extra space surrounding the fittings is limited. Although first transition portion 28 is illustratively shown here as a right-angle shoulder that abruptly transitions between the body and engagement portions, it should be appreciated that transition portions having other configurations could be used instead. For instance, it is possible to have a transition portion that is tapered according to some straight angle (see the example of FIG. 3), that is tapered according to some curve, or that is tapered according to multiple angles, curves, etc., to cite but a few possibilities. Some of these examples are illustrated in star-shaped hand tool embodiment of FIG. 4.

Figure 4:
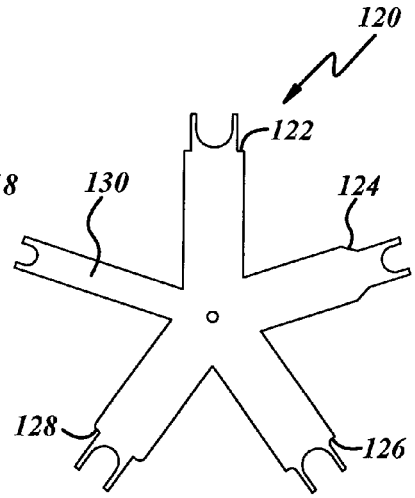
FIG. 4 is a top view of another exemplary embodiment of a hand tool, where the hand tool has a generally star-shaped arrangement.

Second engagement and transition portions 26, 30 are located at an opposing end of exemplary hand tool 20 from first engagement and transition portions 24, 28. According to one embodiment, second engagement portion 26 has an open pocket that is different in size and/or shape than open pocket 52; this enables the two engagement portions to be used with tubes of differing sizes and/or shapes, while still being maintained on a single tool. Because of similarities between first and second engagement and transition portions, a duplicative explanation has been omitted here. It should be appreciated that hand tool 20 does not need to have exactly two engagement portions, as embodiments could be used that have a single engagement portion or that have more than two engagement portions. An example of an embodiment having more than two engagement portions is shown in FIG. 4 and will be subsequently described in more detail.

In operation, an operator can manually grip hand tool 20 and use it to engage a release feature 14 of a push-lock fitting 12 so that a tube, hose, or other conduit 18 can be easily inserted into and/or removed from the fitting. With reference to FIGS. 1 and 2, an operator can slip a first engagement portion 24 around the exterior surface of tube 18 and move the hand tool into position so that contact surface 70 contacts release feature 14. It is preferable that the hand tool be oriented in such a way that contact surface 70 engage the flat, outer ring-shaped surface of release feature 14 so that the two components are flat against one another. Once hand tool 20 is properly seated against release feature 14, the operator can exert a force in the direction x (generally, this direction is perpendicular to the length of hand tool 20). Because contact surface 70 adequately surrounds a circumferential portion of tube 18, an even and uniform force can be applied to the annular release feature 14. This inwardly depressing force causes release feature 14 to evenly retract within fitting housing 16 so that the internal clamping features fully release tube 18, which can then be pulled out of the fitting with the operator's other hand.

A similar process can be used to insert a tube into push-lock fitting 12. In an installation process, release feature 14 is first depressed with hand tool 20 so that the internal clamping features can retract to an out-of-the-way position. Once release feature 14 is sufficiently engaged or depressed, a tube or other conduit can be inserted into push-lock fitting 12 and the operator can relinquish hand tool from the release feature. Although the foregoing explanation has been provided in the context of a hand tool for manual operation, it is possible to utilize hand tool 20 in a machine or piece of equipment for automated use.

In another embodiment, multiple body portions are attached to each other to form a single hand tool so that an operator can select from among the various size engagement portions. For example, a first body portion having engagement portions with open pockets of ¼" and ⅜" could be pivotally or non-pivotally attached to a second body portion having ½" and ⅝" open pockets, and so on. In this way, a single hand tool could include a variety of engagement portions having different sizes and/or shapes. This would enable an operator to carry a single tool that could accommodate various size tubes, etc. According to the particular embodiment shown here, the multiple body portions are pivotally connected to each other by a screw or similar component that passes through a hole 80 in the body portion. Of course, other embodiments could be used as well.

Figure 3:
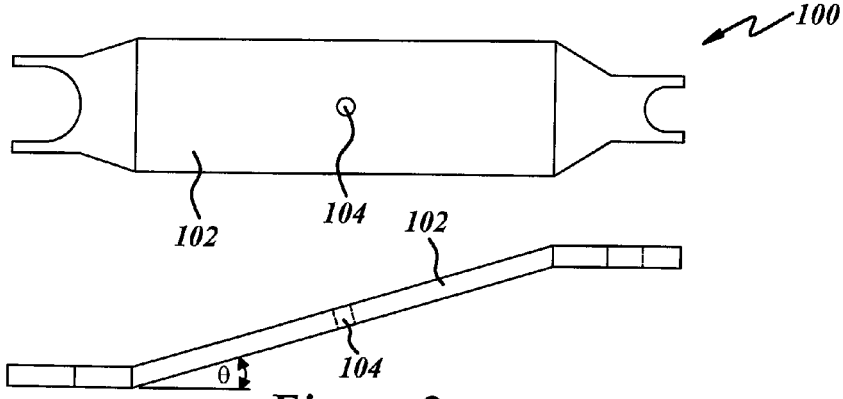
FIG. 3 includes a top and side view of another exemplary embodiment of a hand tool, where the hand tool is bent between its opposing ends.

Turning now to FIG. 3, there is shown another embodiment of a hand tool 100 that can be used to engage a push-lock fitting 12 for proper installation and/or removal of a tube 18. Unlike the previous embodiment where body portion 22 is elongated and generally flat between the first and second engagement portions, hand tool 100 includes a body portion 102 that is elongated and generally bent between first and second engagement portions. For purposes of explanation, a suitable bend angle θ could include from about 30°-45°. In some applications, a bent configuration like this can be useful in reaching difficult to access fittings and the like. As before, multiple bent body portions 102 can be pivotally or non-pivotally connected to one another via a screw 104, etc. Any combination of features and attributes previously described in connection with hand tool 20 could be used with hand tool 100, for example.

In another exemplary embodiment shown in FIG. 4, a hand tool 120 is shown having multiple body portions that are unitary with one another and fixedly connected to each other in a generally star-shaped configuration. This enables an operator to carry a single tool and select the engagement portion that they wish to use. It is possible to fabricate hand tool 120 out of a single piece of metal, for example, thereby reducing manufacturing costs. For purposes of illustration, hand tool 120 is equipped with various types of transition portions 122, 124, 126, 128. Transition portion 122 is a squared off transition similar to that in FIG. 2, transition portion 124 is a straight angled taper similar to that of FIG. 3, transition portion 126 includes a concaved curve, and transition portion 128 includes a convex curve. Leg 130 of star-shaped hand tool 120 includes no transition at all; that is, the body and engagement portions have the same outer width and thus require no transition or taper. Again, the various transitions shown in this embodiment are for purposes of illustration, as hand tool 120 could include any combination of transitions and non-transitions and is not limited to the exemplary design shown in FIG. 4. Moreover, the hand tools described above could include any combination of transitions and non-transitions, including combinations of those shown here as well as those not in the drawings.

It is to be understood that the foregoing description is not a definition of the invention, but is a description of one or more preferred exemplary embodiments of the invention. The invention is not limited to the particular embodiment(s) disclosed herein, but rather is defined solely by the claims below. For instance, the exemplary hand tools described above could be used with non-push-lock fittings and fittings where multiple tubes or hoses are received in a single fitting, to cite a few possibilities. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A hand tool for engaging a push-lock fitting having a release feature, comprising:

a body portion that is sized and shaped to be manually gripped by an operator; and first and second engagement portions that are located on opposite sides of the body portion and are different sizes, each of the first and second engagement portions includes a contact surface located on a flat side of the engagement portion and an open pocket formed between first and second prongs, the open pocket fits around an exterior surface of a tube so the contact surface can engage the release feature on the push-lock fitting;

wherein first and second transition portions are located between the body portion and the first and second engagement portions, respectively, and the body portion is wider than the engagement portions.

2. The hand tool of claim 1, wherein the body portion includes an ergonomic gripping feature on an exterior surface for manual engagement by an operator.

3. The hand tool of claim 1, wherein the open pocket has a coating on an inner surface for preventing damage to the exterior surface of the tube.

4. The hand tool of claim 1, wherein the open pocket has a semi-circular shape that is slightly larger in size than the exterior surface of the tube with which the open pocket engages.

5. The hand tool of claim 1, wherein each of the first and second prongs has a curved inner surface that is part of the open pocket and a straight outer surface that helps define the engagement portion.

6. The hand tool of claim 1, wherein the contact surface of the engagement portion extends around the open pocket for a distance that is equal to or greater than one third of the circumference of the tube with which the contact surface engages.

7. The hand tool of claim 1, wherein the contact surface of the engagement portion is located on the flat side of the hand tool and enables an operator to exert a force against the release feature of the push-lock fitting in a direction x.

8. The hand tool of claim 1, further comprising a transition portion located between the body portion and the engagement portion, wherein the transition portion is a transition between a wider body portion and a narrower engagement portion.

9. The hand tool of claim 1, further comprising a first engagement portion located at a first end of the body portion and a second engagement portion located at a second end of the body portion, wherein each of the first and second engagement portions have open pockets of differing sizes that accommodate tubes of differing sizes.

10. The hand tool of claim 9, wherein the body portion is elongated and is generally flat between the first and second ends.

11. The hand tool of claim 9, wherein the body portion is elongated and is generally bent between the first and second ends.

12. The hand tool of claim 1, further comprising at least one additional body portion having first and second engagement portions located at first and second ends, wherein the multiple body portions are distinct and pivotally connected to each other so that an operator can select the engagement portion that they wish to use.

13. The hand tool of claim 1, further comprising at least one additional body portion having first and second engagement portions located at first and second ends, wherein the multiple body portions are unitary and fixedly connected to each other so that an operator can select the engagement portion that they wish to use.

14. A hand tool for engaging a push-lock fitting having a release feature, comprising:

an elongated body portion that extends between first and second ends;

a first engagement portion located at the first end, the first engagement portion includes a first open pocket that is formed between a pair of prongs and fits around an exterior surface of a tube so that contact surfaces on a flat side of the hand tool can engage the release feature of the push-lock fitting;

a first transition portion located between the body portion and the first engagement portion;

a second engagement portion located at the second end, the second engagement portion includes a second open pocket that is formed between a pair of prongs and fits around an exterior surface of a tube so that contact surfaces on a flat side of the hand tool can engage the release feature of the push-lock fitting, wherein the first and second open pockets are different sizes; and a second transition portion located between the body portion and the second engagement portion, wherein the body portion is wider than the engagement portions.

15. The hand tool of claim 13, wherein the multiple body portions have different sizes so that one body portion is wider than the other body portions.

16. The hand tool of claim 13, wherein the first and second engagement portions of the multiple body portions have different sizes so that all of the engagement portions are a different size.

17. The hand tool of claim 13, wherein the multiple body portions are arranged around the hand tool in a star-shaped configuration.

18. The hand tool of claim 13, wherein the star-shaped configuration has different sizes so that one body portion is wider than the other body portions.

* * * * *